US011047290B2

(12) United States Patent
Heald

(10) Patent No.: US 11,047,290 B2
(45) Date of Patent: Jun. 29, 2021

(54) SYSTEMS AND METHODS FOR CONTROLLING PISTON COOLING NOZZLES USING CONTROL VALVE ACTUATOR

(71) Applicants: Cummins Inc., Columbus, IN (US); Brett A. Heald, Indianapolis, IN (US)

(72) Inventor: Brett A. Heald, Indianapolis, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/767,381

(22) PCT Filed: Nov. 27, 2017

(86) PCT No.: PCT/US2017/063239
§ 371 (c)(1),
(2) Date: May 27, 2020

(87) PCT Pub. No.: WO2019/103749
PCT Pub. Date: May 31, 2019

(65) Prior Publication Data

US 2020/0392889 A1 Dec. 17, 2020

(51) Int. Cl.
*F01P 3/08* (2006.01)
*F01M 1/08* (2006.01)
(Continued)

(52) U.S. Cl.
CPC ..... *F01P 3/08* (2013.01); *F01M 1/08* (2013.01); *F01M 2001/083* (2013.01);
(Continued)

(58) Field of Classification Search
CPC .. F01P 5/10; F01P 2003/006; F01P 2003/021; F01P 2007/146; F01P 4/14; F02F 3/22
See application file for complete search history.

(56) References Cited

U.S. PATENT DOCUMENTS 5,819,692 A 10/1998 Schafer
7,240,643 B1 7/2007 Perr et al.
(Continued)

FOREIGN PATENT DOCUMENTS

KR 101033318 B1 5/2011

OTHER PUBLICATIONS

International Search Report and Written Opinion issued by the ISA/US, Commissioner for Patents, dated Feb. 16, 2018 for International Application No. PCT/US2017/063239; 10 pages.
(Continued)

*Primary Examiner* — George C Jin
(74) *Attorney, Agent, or Firm* — Faegre Drinker Biddle & Reath LLP

(57) ABSTRACT

A control system (10) used for an engine (14) having at least one cylinder (18) is provided for a piston cooling nozzle (PCN (12)). Included in the control system (10) are a main liquid rifle (20) configured to deliver a liquid to the at least one cylinder (18) of the engine (14), and a PCN liquid rifle (22) disposed inside the main liquid rifle (20) for directing the liquid from the main liquid rifle (20) to the PCN (12). The control system (10) causes the liquid to be jetted into the at least one cylinder (18) of the engine (14) for lowering a temperature of the engine (14).

20 Claims, 4 Drawing Sheets

(51) Int. Cl.
*F01P 7/14* (2006.01)
*F01P 3/00* (2006.01)

(52) U.S. Cl.
CPC ..... *F01P 7/14* (2013.01); *F01P 2003/006* (2013.01); *F01P 2007/146* (2013.01); *F01P 2025/32* (2013.01)

(56) References Cited

U.S. PATENT DOCUMENTS

| | | | | |
|---|---|---|---|---|
| 8,639,411 | B2 | 1/2014 | Bruno et al. | |
| 8,746,193 | B2 | 6/2014 | Bowler et al. | |
| 2005/0120982 | A1 | 6/2005 | Ducu | |
| 2014/0035392 | A1 | 2/2014 | Jeong et al. | |
| 2014/0305392 | A1* | 10/2014 | Clement | F01P 3/08 123/41.35 |
| 2015/0275713 | A1 | 10/2015 | Bidner et al. | |
| 2016/0363034 | A1* | 12/2016 | Kim | F01M 11/02 |

OTHER PUBLICATIONS

International Preliminary Report on Patentability issued by the Commissioner for Patents, dated Dec. 19, 2019 for International Application No. PCT/US2017/063239; 12 pages.

* cited by examiner

SYSTEMS AND METHODS FOR CONTROLLING PISTON COOLING NOZZLES USING CONTROL VALVE ACTUATOR

CROSS-REFERENCE TO RELATED APPLICATIONS

The present application is a national phase filing under 35 U.S.C. § 371 of International Application No. PCT/US2017/063239, titled "SYSTEMS AND METHODS FOR CONTROLLING PISTON COOLING NOZZLES USING CONTROL VALVE ACTUATOR," filed on Nov. 27, 2017, the entire disclosure of which being expressly incorporated herein by reference.

TECHNICAL FIELD

The present disclosure relates generally to systems and methods for controlling piston cooling nozzles, and more specifically to a control system and method for actuating the piston cooling nozzles in an internal combustion engine.

BACKGROUND

Conventional piston cooling nozzles (PCNs) typically deliver oil to pistons of an internal combustion engine to transfer heat away from pistons. During operation, some of the heat resulting from fuel combustion is absorbed by the pistons, causing an undesirable temperature rise in the engine. Without adequate heat transfer away from the pistons, carbon deposits are undesirably increased on the pistons. One way to reduce this excess heat is through the use of PCNs. For example, a PCN generally has an inlet which receives relatively cool oil from an engine oil distribution system and an outlet which directs the cooled oil toward the piston associated with the PCN. The cool oil contacts surfaces of the piston to transfer heat away from the piston.

However, such conventional thermal management systems actuate the PCNs mainly based on an oil pressure in a main oil rifle disposed on a cylinder block of the engine. For example, when the oil pressure in the main oil rifle is greater than a predetermined threshold, the PCNs are opened to deliver the cooled oil to the pistons. In such configurations, the PCNs are operated regardless of an engine temperature but based solely on the oil pressure in the main oil rifle. Thus, during a cold start period of the engine, such conventional systems delay an engine warm-up process by cooling the pistons of the engine prematurely. Accordingly, there exists a need to control the PCNs to prevent premature operation during conditions under which the engine warm-up process is desired.

SUMMARY

According to one embodiment, the present disclosure provides a control system used for an engine having at least one cylinder, and includes a piston cooling nozzle (PCN), a main liquid rifle configured to deliver a liquid, such as oil or coolant, to the at least one cylinder of the engine, and a PCN liquid rifle disposed inside the main liquid rifle for directing the liquid from the main liquid rifle to the PCN, causing the liquid delivered to the at least one cylinder of the engine to lower a temperature of the engine.

In one example, the control system further includes a central control unit configured to control operation of the PCN using a control valve actuator fluidly connected to the PCN liquid rifle. In a variation, the PCN liquid rifle has a first end that is sealed and an opposite second end that is fluidly connected to the control valve actuator. In a further variation, the central control unit is configured to control open and close operation of the control valve actuator based on at least one engine attribute. In another variation, the at least one engine attribute includes at least one of: an engine speed, a temperature associated with the engine, and a fuel amount injected into the at least one cylinder. In yet another variation, the temperature associated with the engine includes at least one of: a coolant temperature, a liquid temperature, and an engine component temperature.

In another example, the PCN includes a tube configured to direct the liquid into the at least one cylinder, and a fastening body configured to mount the PCN to the PCN liquid rifle for directing the liquid from the PCN liquid rifle into the at least one cylinder via the tube. In a variation, the fastening body has an opening end that is inserted into a bore of the main liquid rifle and a port on the PCN liquid rifle for accommodating a delivery of the liquid from the PCN liquid rifle to the at least one cylinder. In a further variation, the PCN liquid rifle is fully inserted into the main liquid rifle such that the PCN liquid rifle is completely enclosed by the main liquid rifle. In another variation, a diameter of the PCN liquid rifle is less than a diameter of the main liquid rifle to provide a liquid flow between the main liquid rifle and the PCN liquid rifle.

According to another embodiment, the present disclosure provides a control method for a piston cooling nozzle (PCN) used in an engine (14) having at least one cylinder (18), and includes delivering a liquid to the at least one cylinder of the engine via a main liquid rifle; disposing a PCN liquid rifle inside the main liquid rifle; and directing the liquid from the main liquid rifle to the PCN via the PCN liquid rifle, thereby causing the liquid to be injected or jetted into the at least one cylinder of the engine for lowering a temperature of the engine.

In one example, the control method further includes controlling operation of the PCN using a control valve actuator fluidly connected to the PCN liquid rifle. In a variation, the method further includes including, for the PCN liquid rifle, a first end that is sealed and an opposite second end that is fluidly connected to the control valve actuator. In a further variation, the method further includes controlling open and close operation of the control valve actuator based on at least one engine attribute. In another variation, the method further includes including, as the at least one engine attribute, at least one of: an engine speed, a temperature associated with the engine, and a fuel amount injected into the at least one cylinder. In yet another variation, the method further includes including, as the temperature associated with the engine, at least one of: a coolant temperature, a liquid temperature, and an engine component temperature.

In another example, the method further includes including, for the PCN, a tube configured to direct the liquid into the at least one cylinder, and a fastening body configured to mount the PCN to the PCN liquid rifle for directing the liquid from the PCN liquid rifle into the at least one cylinder via the tube. In a variation, the method further includes including, for the fastening body, an opening end that is inserted into a bore of the main liquid rifle and a port on the PCN liquid rifle for accommodating a delivery of the liquid from the PCN liquid rifle to the at least one cylinder. In a further variation, the method further includes inserting the PCN liquid rifle fully into the main liquid rifle such that the PCN liquid rifle is completely enclosed by the main liquid rifle. In another variation, constructing the PCN liquid rifle such that a diameter of the PCN liquid rifle is less than a diameter of the main liquid rifle to provide a liquid flow between the main liquid rifle and the PCN liquid rifle.

While multiple embodiments are disclosed, still other embodiments of the present disclosure will become apparent to those skilled in the art from the following detailed description, which shows and describes illustrative embodiments of the present disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
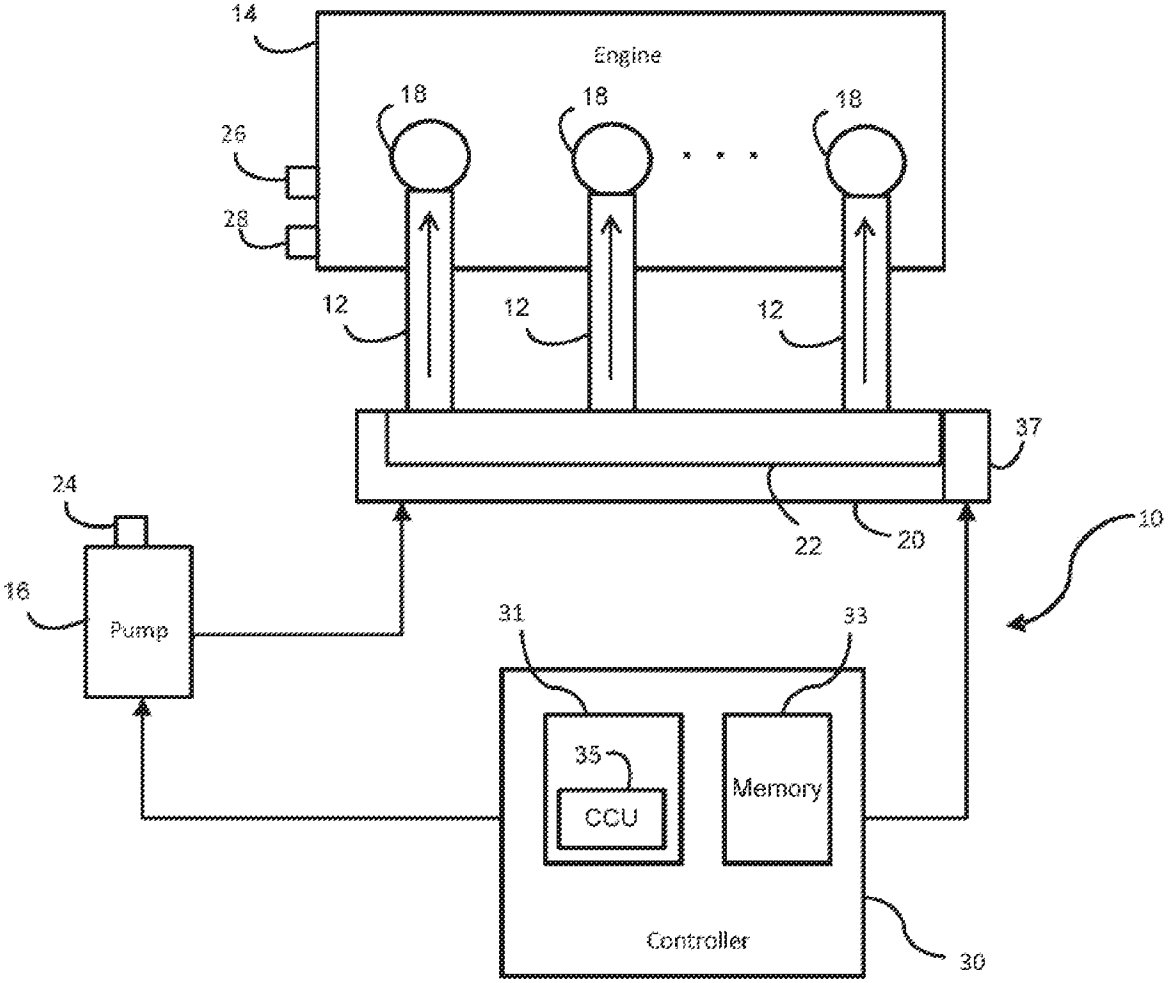
FIG. 1 is a functional block diagram of a PCN control system, featuring a central control unit.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate an exemplary embodiment of the disclosure, in one form, and such exemplifications are not to be construed as limiting the scope of the disclosure in any manner.

DETAILED DESCRIPTION

Embodiments of the present disclosure are described below by way of example only, with reference to the accompanying drawings. Further, the following description is merely exemplary in nature and is in no way intended to limit the disclosure, its application, or uses. As used herein, the term "unit" or "module" may refer to, be part of, or include an Application Specific Integrated Circuit (ASIC), an electronic circuit, a processor or microprocessor (shared, dedicated, or group) and/or memory (shared, dedicated, or group) that executes one or more software or firmware programs, a combinational logic circuit, and/or other suitable components that provide the described functionality. Thus, while this disclosure includes particular examples and arrangements of the units, the scope of the present safety control system should not be so limited since other modifications will become apparent to the skilled practitioner.

One of ordinary skill in the art will realize that the embodiments provided can be implemented in hardware, software, firmware, and/or a combination thereof. Programming code according to the embodiments can be implemented in any viable programming language such as C, C++, HTML, XTML, JAVA or any other viable high-level programming language, or a combination of a high-level programming language and a lower level programming language.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

Referring now to FIG. 1, a PCN control system 10 is shown that controls operation of one or more PCNs 12 mounted to an engine 14. In this example, PCN 12 receives relatively cool liquid from a liquid pump 16 and directs the cooled liquid into one or more cylinders 18 associated with PCNs 12 via a main liquid rifle 20 and a PCN liquid rifle 22 disposed inside main liquid rifle 20. For example, the liquid can be oil or any other suitable liquids or gaseous medium known in the art. Other liquid substitutes are also contemplated. Although three cylinders 18 are shown in FIG. 1, any number of cylinders is contemplated to suit the application. PCN control system 10 includes one or more sensors 24-28 to provide information about current operation of engine 14. For example, a liquid temperature sensor 24 is in communication with liquid pump 16 or a liquid tank (not shown) to measure a current temperature of liquid supplied to main liquid rifle 20. A coolant temperature sensor 26 is provided to measure a current temperature of coolant in engine 14. A speed sensor 28 is provided to measure an engine speed of engine 14 (e.g., RPM). Other suitable sensors are also contemplated to suit different applications.

As shown, a controller 30 generally includes a processor 31 and a non-transitory memory 33 having computer-executable instructions that, in response to execution by processor 31, cause processor 31 to perform the various functions of controller 30 described herein. Processor 31, non-transitory memory 33, and controller 30 are not particularly limited and may, for example, be physically separate. Moreover, in certain embodiments, controller 30 may form a portion of a processing subsystem including one or more computing devices having memory, processing, and communication hardware. Controller 30 may be a single device or a distributed device, and the functions of the controller 30 may be performed by hardware and/or as computer instructions on a non-transient computer readable storage medium, such as non-transitory memory 33.

Included in the processor 31 is a central control unit ("CCU") 35 configured to control operation of at least one PCN 12. In embodiments, CCU 35 is designed to control open and close operation of a control valve actuator ("CVA") 37 based on at least one engine attribute. Exemplary engine attributes include an engine speed (e.g., RPM), a temperature associated with engine 14, such as a coolant temperature (e.g., Celsius ° C. or Fahrenheit ° F.), a liquid temperature (e.g., ° C. or ° F.), and an engine temperature. Further included in the engine attributes are a fuel amount injected into each cylinder 18, and a fuel/air ratio used for each cylinder 18. Other suitable engine attributes, such as a torque value or an engine power level, are also contemplated to suit the application. Any combination of the engine attributes can be used to control operation of PCN 12. In one example, the fuel amount injected is variable depending on a slope degree of a road. In another example, the torque value is variable depending on an engine load or speed level. Thus, CCU 35 provides, among other things, an approach to controlling PCN operation by using CVA 37 based on the at least one engine attribute.

As such, CCU 35 controls operation of CVA 37 for avoiding premature operation of PCNs 12 during the cold start period of engine 14. For example, the cold start period refers to time durations related to cold idle, start-up time, cold ambient, engine initial start, and the like. In one example, idle conditions can result in a slow engine warm-up process, and thus a shorter engine warm-up time is desired to reach a predetermined engine temperature as quickly as possible. CVA 37 is useful to reduce the engine warm-up time during idle conditions by inactivating PCNs 12 until engine 14 reaches the predetermined engine temperature. Thus, it is advantageous that CCU 35 is helpful for reaching the predetermined engine temperature in a shortest time available during the cold start period.

In certain embodiments, controller 30 includes one or more interpreters, determiners, evaluators, regulators, and/or processors that functionally execute the operations of controller 30. The description herein including interpreters, determiners, evaluators, regulators, and/or processor emphasizes the structural independence of certain aspects of controller 30, and illustrates one grouping of operations and responsibilities of the controller. Other groupings that execute similar overall operations are understood within the scope of the present application. Interpreters, determiners, evaluators, regulators, and processors may be implemented in hardware and/or as computer instructions on a non-transient computer readable storage medium, and may be distributed across various hardware or computer based components.

Example and non-limiting implementation elements that functionally execute the operations of controller 30 include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state, any actuator including at least an electrical, hydraulic, or pneumatic actuator, a solenoid, an op-amp, analog control elements (springs, filters, integrators, adders, dividers, gain elements), and/or digital control elements.

Certain operations described herein include operations to interpret and/or to determine one or more parameters or data structures. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a computer generated parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Figure 2:
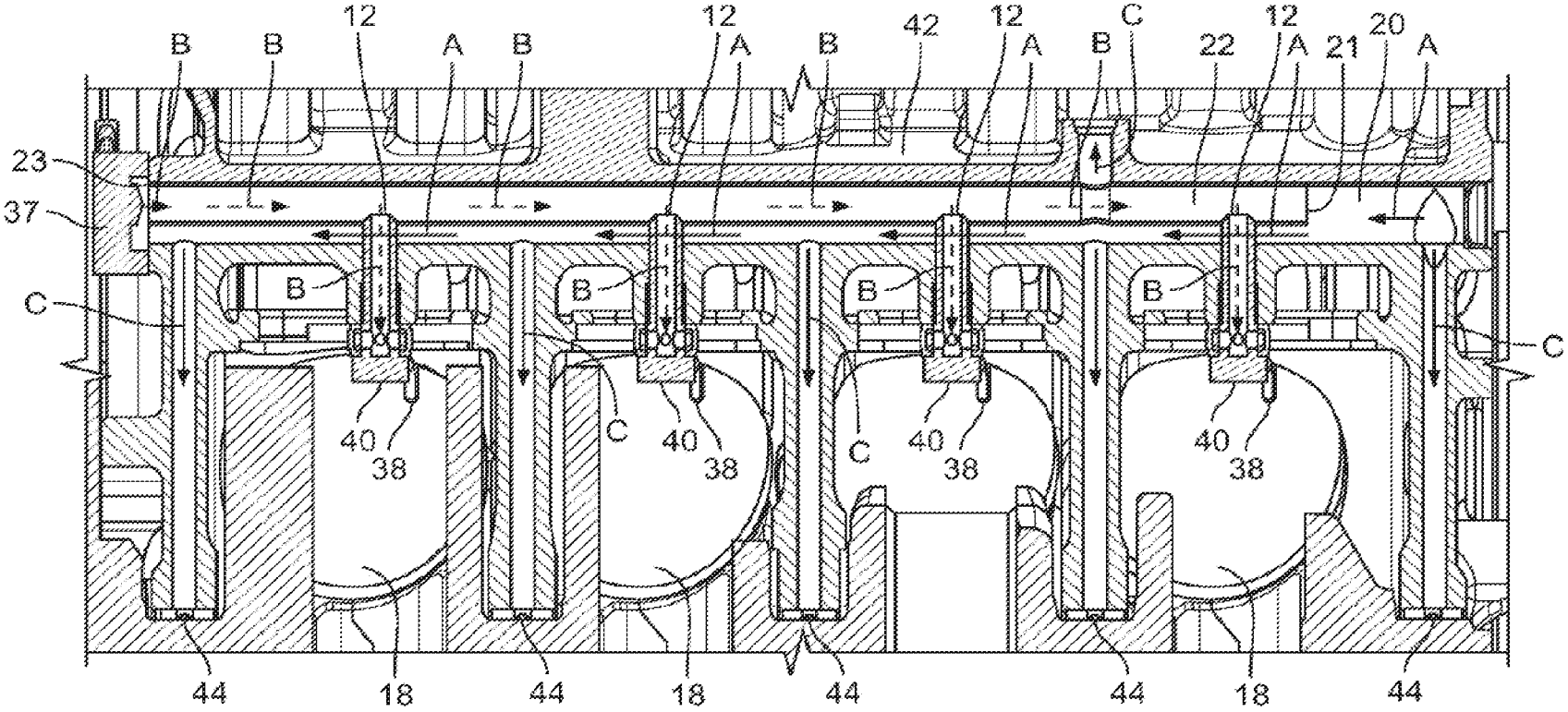
FIG. 2 is a partial cross-sectional side view of an exemplary engine incorporating the PCN control system of FIG. 1.
Figure 3:
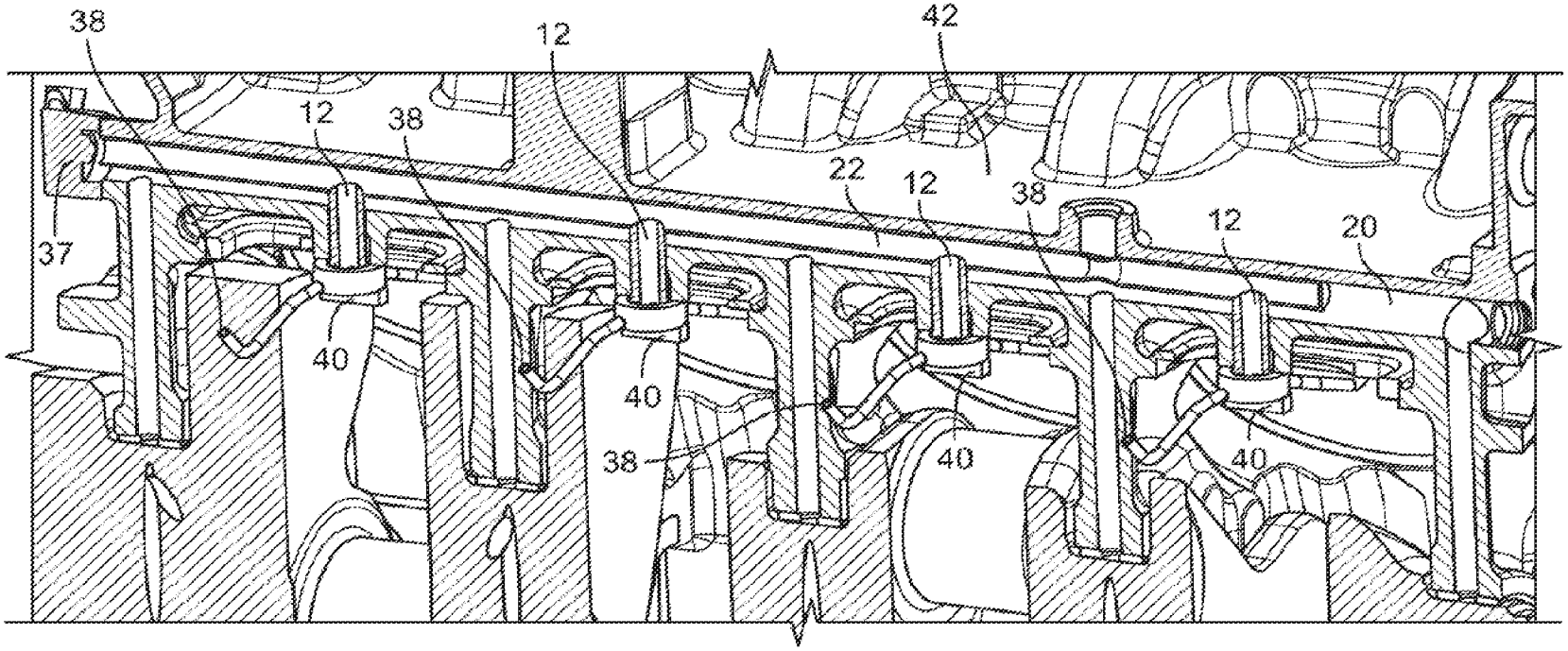
FIG. 3 is a partial cross-sectional perspective view of the exemplary engine of FIG. 2.
Figure 4:
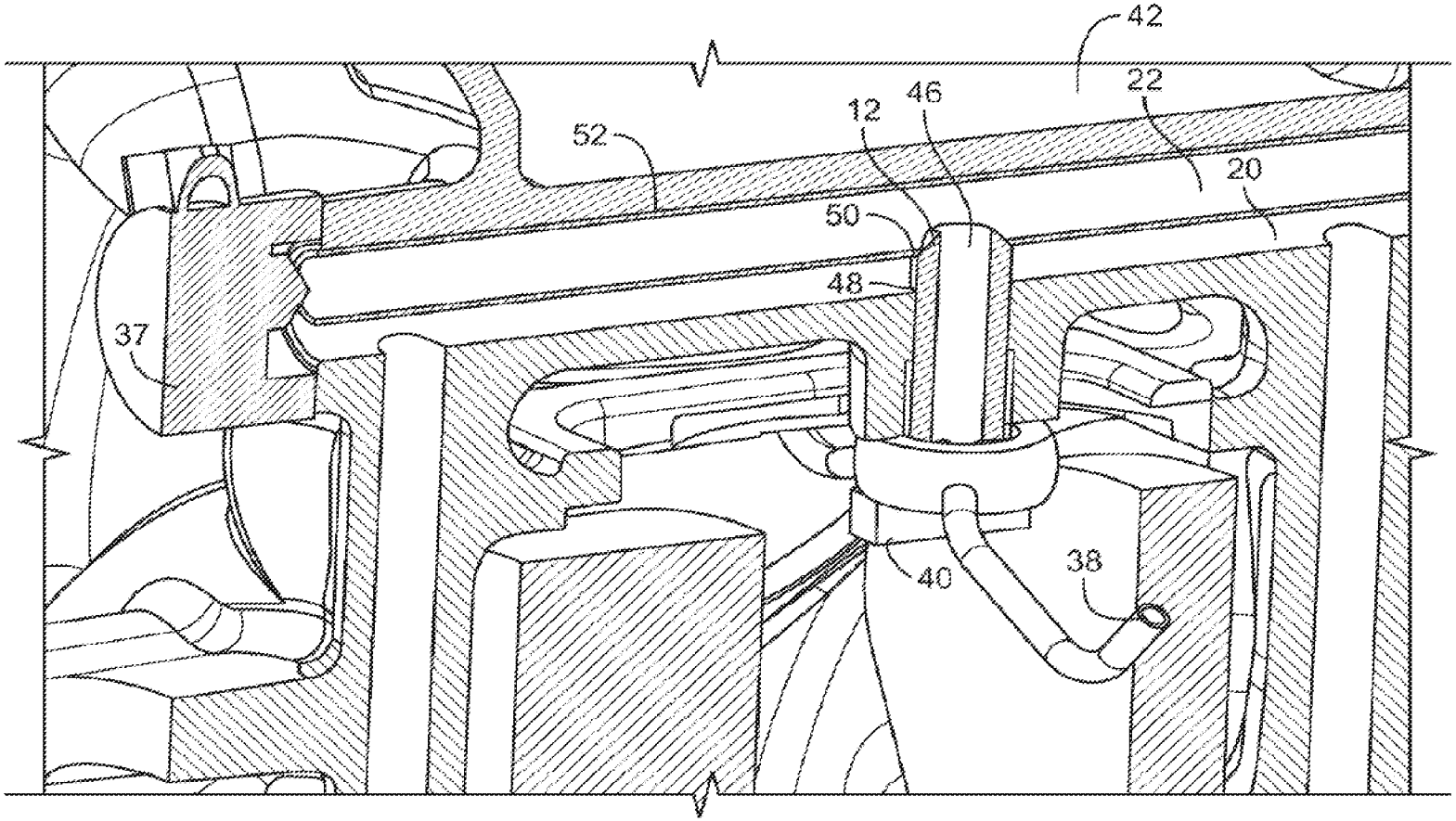
FIG. 4 is an enlarged cross-sectional perspective view of the exemplary engine of FIG. 2.

Referring now to FIGS. 2-4, an exemplary arrangement of PCNs 12 and CVA 37 is shown according to one embodiment of the present disclosure for use with engine 14. Each PCN 12 generally includes a tube 38 configured to direct liquid into a corresponding cylinder 18 and a fastening body 40 configured for mounting PCN 12 to PCN liquid rifle 22 and directing a supply of liquid to tube 38 in fluid communication with PCN liquid rifle 22. In this example, PCN liquid rifle 22 is mounted to a cylinder block 42 for facilitating secure attachment to engine 14.

In FIG. 2, an exemplary liquid flow network of PCN control system 10 is illustrated as a schematic diagram. In this example, main liquid rifle 20 is fluidly connected to liquid pump 16 for receiving the cooling liquid, and a flow path, designated by arrows A, of liquid exiting from liquid pump 16 enters main liquid rifle 20. In one embodiment, PCN liquid rifle 22 is an elongated steel tube fully inserted into main liquid rifle 20 such that PCN liquid rifle 22 is completely enclosed by main liquid rifle 20. A first end 21 of PCN liquid rifle 22 is sealed and an opposite second end 23 is fluidly connected to CVA 37. As such, a diameter of PCN liquid rifle 22 is less than a diameter of main liquid rifle 20 to provide the liquid flow between main liquid rifle 20 and PCN liquid rifle 22.

In this example, there are various flow paths A, B, C on each branch of main liquid rifle 20 depicting separate flows from main liquid rifle 20. For example, a flow path C is directed to main bearings 44, rod bearings, piston cooling jets, and camshaft gear train. Flow paths A, B, C are examples of exit points from main liquid rifle 20. Specifically, the liquid is routed from main liquid rifle 20 to PCN liquid rifle 22, designated by arrows B, and a flow path B is controlled by CCU 35 using CVA 37. For example, CCU 35 controls both the liquid flow and liquid pressure within PCN liquid rifle 22 for accommodating a selective delivery of the cooling liquid into cylinders 18.

In FIG. 4, an exemplary attachment of PCN 12 to main liquid rifle 20 and PCN liquid rifle 22 is shown. In this example, an opening end 46 of fastening body 40 of PCN 12 is inserted into a bore 48 of main liquid rifle 20 and a port 50 on PCN liquid rifle 22 for accommodating the delivery of the liquid from PCN liquid rifle 22 to a corresponding cylinder 18 via tube 38. Each fastening body 40 of PCN 12 is fastened to a corresponding port 50 on PCN liquid rifle 22 to provide clamp load for retaining PCN liquid rifle 22 in place inside main liquid rifle 20 and sealing port 50. In embodiments, fastening body 40 has an inner cavity connected to tube 38 for accommodating the liquid flow between PCN liquid rifle 22 and cylinder 18.

In this configuration, while PCN 12 is fluidly and directly connected to PCN liquid rifle 22, PCN 12 is not fluidly and directly connected to main liquid rifle 20. Thus, when CVA 37 is opened by CCU 35, the liquid freely flows from PCN liquid rifle 22 into opening end 46 of PCN 12, but when CVA 37 is closed by CCU 35, the liquid flow between PCN liquid rifle 22 and PCN 12 is blocked. In one embodiment, PCN 12 includes a check valve that opens only when the pressure within PCN liquid rifle 22 reaches a predetermined value. As such, the delivery of the liquid into cylinders 18 is selectively controlled by CCU 35. Another aspect of the present disclosure is that fastening body 40 of PCN 12 directly biases or pushes against PCN liquid rifle 22 toward an upper surface or ceiling 52 of main liquid rifle 20 for facilitating secure attachment of PCN liquid rifle 22 to main liquid rifle 20.

It should be further understood that, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

While the present disclosure has been described as having exemplary designs, the present disclosure can be further modified within the spirit and scope of this disclosure. This application is therefore intended to cover any variations, uses, or adaptations of the present disclosure using its general principles. Further, this application is intended to cover such departures from the present disclosure as come within known or customary practice in the art to which this present disclosure pertains and which fall within the limits of the appended claims. For example, a liquid substitute, such as water or any other liquid or any gaseous medium that has a primary supply which provides water, liquid, or gaseous medium to a dominant portion of a system is also contemplated. A secondary supply, such as water, liquid, or gaseous medium, encapsulated by the primary supply uses an actuating valve which is controlled by CCU 35 that uses a second set of parameters to control the secondary supply flow of water, liquid, or gaseous medium.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

I claim:

1. A control system used for an engine having at least one cylinder, comprising:

a piston cooling nozzle (PCN);

a main liquid rifle configured to deliver a liquid to the at least one cylinder of the engine; and a PCN liquid rifle disposed inside the main liquid rifle for directing the liquid from the main liquid rifle to the PCN, causing the liquid delivered to the at least one cylinder of the engine to lower a temperature of the engine, wherein the PCN is fluidly and directly connected to the PCN liquid rifle but not fluidly and directly connected to the main liquid rifle for accommodating a delivery of the liquid from the PCN liquid rifle to the at least one cylinder.

2. The control system of claim 1, further comprising a central control unit configured to control operation of the PCN using a control valve actuator (CVA) fluidly connected to the PCN liquid rifle.

3. The control system of claim 2, wherein the PCN liquid rifle has a first end that is sealed and an opposite second end that is fluidly connected to the CVA.

4. The control system of claim 2, wherein the central control unit (CCU) is configured to control open and close operation of the CVA based on at least one engine attribute.

5. The control system of claim 4, wherein the at least one engine attribute includes at least one of: an engine speed, a temperature associated with the engine, and a fuel amount injected into the at least one cylinder.

6. The control system of claim 5, wherein the temperature associated with the engine includes at least one of: a coolant temperature, a liquid temperature, and an engine component temperature.

7. The control system of claim 1, wherein the PCN includes a tube configured to direct the liquid into the at least one cylinder, and a fastening body configured to mount the PCN to the PCN liquid rifle for directing the liquid from the PCN liquid rifle into the at least one cylinder via the tube.

8. The control system of claim 7, wherein the fastening body has an opening end that is inserted into a bore of the main liquid rifle and a port on the PCN liquid rifle for accommodating the delivery of the liquid from the PCN liquid rifle to the at least one cylinder.

9. The control system of claim 1, wherein the PCN liquid rifle is fully inserted into the main liquid rifle such that the PCN liquid rifle is completely enclosed by the main liquid rifle.

10. The control system of claim 1, wherein a diameter of the PCN liquid rifle is less than a diameter of the main liquid rifle to provide a liquid flow between the main liquid rifle and the PCN liquid rifle.

11. A control method for a piston cooling nozzle (PCN) used in an engine having at least one cylinder, comprising:

delivering a liquid to the at least one cylinder of the engine via a main liquid rifle;

disposing a PCN liquid rifle inside the main liquid rifle;

directing the liquid from the main liquid rifle to the PCN via the PCN liquid rifle, thereby causing the liquid to be jetted into the at least one cylinder of the engine for lowering a temperature of the engine; and fluidly and directly connecting the PCN to the PCN liquid rifle but not fluidly and directly connecting the PCN to the main liquid rifle for accommodating a delivery of the liquid from the PCN liquid rifle to the at least one cylinder.

12. The method of claim 11, further comprising controlling operation of the PCN using a control valve actuator (CVA) fluidly connected to the PCN liquid rifle.

13. The method of claim 12, further comprising including, for the PCN liquid rifle, a first end that is sealed and an opposite second end that is fluidly connected to the CVA.

14. The method of claim 12, further comprising controlling open and close operation of the CVA based on at least one engine attribute.

15. The method of claim 14, further comprising including, as the at least one engine attribute, at least one of: an engine speed, a temperature associated with the engine, and a fuel amount injected into the at least one cylinder.

16. The method of claim 15, further comprising including, as the temperature associated with the engine, at least one of: a coolant temperature, a liquid temperature, and an engine component temperature.

17. The method of claim 11, further comprising including, for the PCN, a tube configured to direct the liquid into the at least one cylinder, and a fastening body configured to mount the PCN to the PCN liquid rifle for directing the liquid from the PCN liquid rifle into the at least one cylinder via the tube.

18. The method of claim 17, further comprising including, for the fastening body, an opening end that is inserted into a bore of the main liquid rifle and a port on the PCN liquid rifle for accommodating the delivery of the liquid from the PCN liquid rifle to the at least one cylinder.

19. The method of claim 11, further comprising inserting the PCN liquid rifle fully into the main liquid rifle such that the PCN liquid rifle is completely enclosed by the main liquid rifle.

20. The method of claim 11, further comprising constructing the PCN liquid rifle such that a diameter of the PCN liquid rifle is less than a diameter of the main liquid rifle to provide a liquid flow between the main liquid rifle and the PCN liquid rifle.

* * * * *